US007673885B2

(12) United States Patent
Lambert

(10) Patent No.: US 7,673,885 B2
(45) Date of Patent: Mar. 9, 2010

(54) BOARD CONTROL GRIP STEP FOR SNOWBOARDS

(76) Inventor: Robert Louis Lambert, 315 Navarre Ave., Apt. 7, Coral Gables, FL (US) 33134

( * ) Notice: Subject to any disclaimer, the term of this patent is extended or adjusted under 35 U.S.C. 154(b) by 417 days.

(21) Appl. No.: 11/687,481

(22) Filed: Mar. 16, 2007

(65) Prior Publication Data

US 2008/0224449 A1 Sep. 18, 2008

(51) Int. Cl.
*B62B 13/00* (2006.01)
*B62M 1/00* (2006.01)

(52) U.S. Cl. ..... 280/14.21; 280/14.22; 280/87.041; 280/87.042

(58) Field of Classification Search ..... 280/14.21, 280/14.22, 87.041, 87.042
See application file for complete search history.

(56) References Cited

U.S. PATENT DOCUMENTS 6,773,021 B2 * 8/2004 Breuer et al. ..... 280/14.21
6,857,641 B2 * 2/2005 Bobrowicz ..... 280/14.21
6,866,273 B2 * 3/2005 Barbieri et al. ..... 280/14.21
2002/0008360 A1 * 1/2002 Ellington ..... 280/14.21
2002/0070515 A1 * 6/2002 Barbieri et al. ..... 280/14.21
2002/0158430 A1 * 10/2002 Farcot et al. ..... 280/14.21
2003/0085537 A1 * 5/2003 Breuer et al. ..... 280/14.21
2003/0160404 A1 * 8/2003 Bobrowicz ..... 280/14.21
2004/0232656 A1 * 11/2004 Gyr ..... 280/617

* cited by examiner

*Primary Examiner*—Paul N Dickson
*Assistant Examiner*—John R Olszewski

(57) ABSTRACT

This invention would significantly improve the ease of riding a snowboard on ski lifts where typically one foot must remain unbound to push off with. The invention allows for control of the board specifically through the diversion of the gravitational force of weight of the rider through forces of tension, elasticity, and leverage. The diversion of these forces allows the rider to steer roughly in the same manner as if their foot was bound.

7 Claims, 4 Drawing Sheets

Front View

Front View

Top View

Right Side View

BOARD CONTROL GRIP STEP FOR SNOWBOARDS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

This invention pertains to the classification of snowboarding. This invention can be used in accordance with a snowboard or a snowboard binding but it is, in itself, a separate entity with a separate function. This invention, serves as a mechanism to steer the snowboard while one foot is unbound. This technology is currently insufficient or unavailable.

BRIEF SUMMARY OF THE INVENTION

The invention herein described serves to allow the rider of the snowboard (11) to control the snowboard (11) when one foot must be unbound, typically when utilizing the ski lift or traversing flat terrain. The invention serves to do this by providing a step mechanism with a lever (1) and fulcrum (6) system that diverts the downward force of the rider, which is body weight, into modes that allow the rider to manipulate the edges of the snowboard (11) much like the rider is able to do when both feet are bound. The lever (1) and fulcrum (6) system specifically does this by converting downward force on the upper arm of the lever (12) through a fulcrum (6) to a lifting force on the lower arm of the lever (13). This puts pressure on the edge of the snowboard (11) to where the force is applied, while simultaneously, lifting the opposite edge of the snowboard (11).

BRIEF DESCRIPTION OF THE SEVERAL VIEWS OF THE DRAWING

The drawings depict the assembled device in three dimensional views of the front, top and right side of the device. A fourth three dimensional angled view is an added view and it describes the device from a more descriptive perspective. The angled view depict the device in reference to a snowboard (11) and binding (10). In this way the device's utility is defined. Copious amounts of labels depicting various aspects of the device are incorporated into the replacement and added drawings.

FIG. 1 depicts the device from the front where the cross-bars (1), which act as the lever (1) in the fulcrum (6) and lever (1) system, are best shown. The cross-bars (1) effectively connect the base of the device (4) with the step of the device (5). The upper (2) and lower (3) connecting points connect the cross-bars (1) to the step (5) and the base (4). The cross-bars (1) are spaced so that the cross-bars (1) do not touch each other and are allowed to move unimpeded past one another. The step (5) is depicted in a v shape in this figure. This allows the lever (1) to transfer the downward force from its upper arm (12) to a lifting force on its lower arm (13). This lifts the opposite edge of the snowboard (11) to where the downward force was applied. The resulting pressure on one of the snowboard's (11) edges in respect to the other makes the snowboard (11) turn in one direction or the other depending on what edge has the greater pressure.

FIG. 2 best displays the hinge (8) that allows the grin step to be folded up when not in use. The hinge (8) allows the grip step to be folded up towards the binding (10). FIG. 2 also best displays the board connection slots (7) that are used to connect the grip step device under one binding (10) and onto the snowboard (11). The board connection slots (7) are designed to allow bolts that normally pass through the base of the binding (4) and thread into the snowboard (11) to pass through them, as part of the device, up to the hinge (8). is sandwiched between the binding (10) and the snowboard (11).

DETAILED DESCRIPTION OF THE INVENTION

Figure 1:
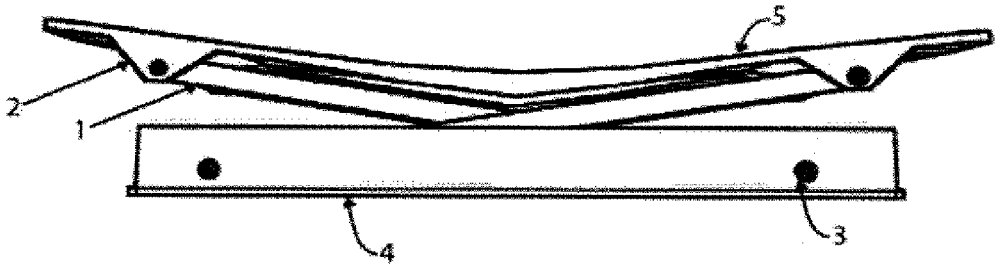
FIG. 1: This figure depicts the three dimensional drawings of the front view of the device. The three dimensional view offers a depth perception to the device and is considered superior to a two dimensional image in terms of the conceptual understanding of the invention.
Figure 2:
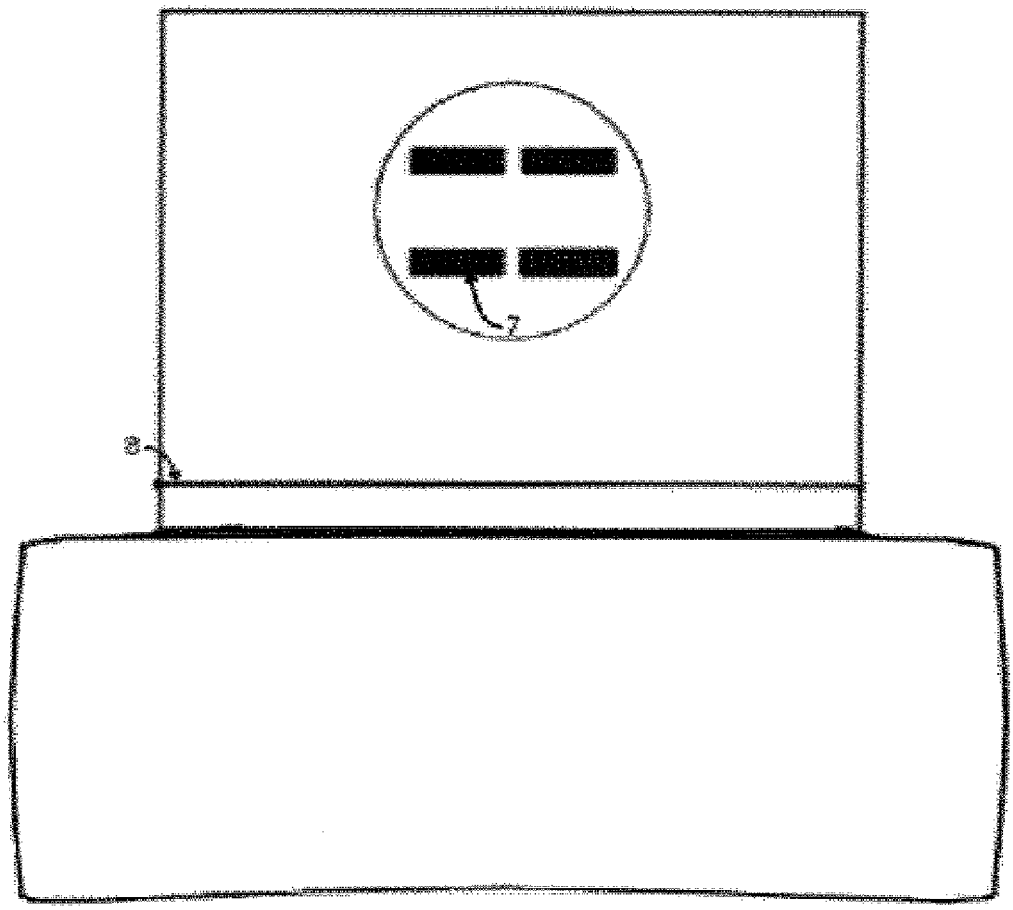
FIG. 2: This figure shows the three dimensional to view of the device which replaces the two dimensional top view of the device in a perspective view.
Figure 3:
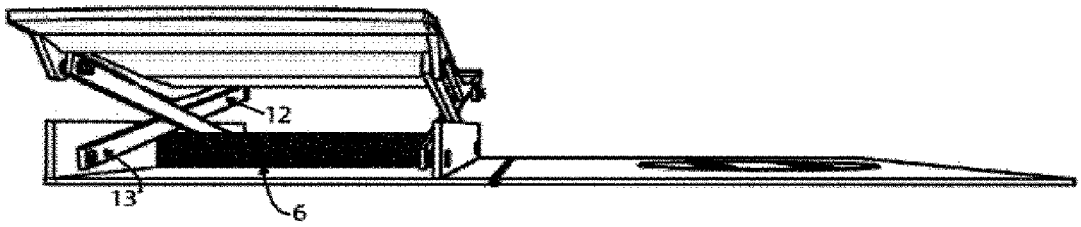
FIG. 3: This figure depicts the device in a three dimensional right side view. From the perspective of this view, it is most convenient to see the fulcrum (6) that acts to convert the forces applied to the levers (1) or cross-bars (1). The figure also depicts and differentiates the upper (12) and lower (13) arms of the lever.
Figure 4:
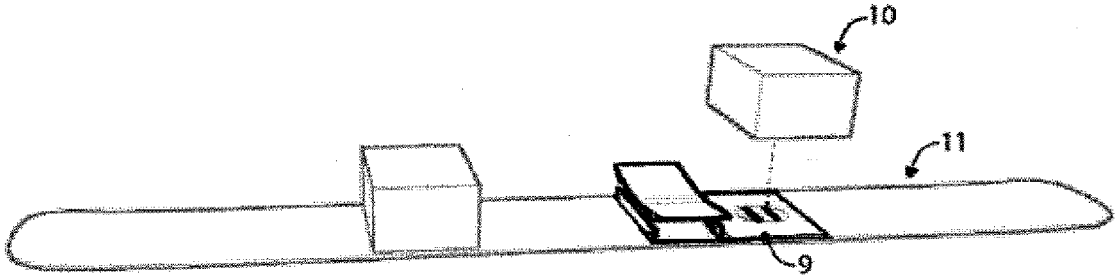
FIG. 4: This figure depicts the device from an angled view and best describes the device and how it is used in relation to the binding (10) and snowboard (11). The device's attachment point (9) is identified in the three dimensional view as the point in between where the binding (10) normally attaches to the snowboard (11).

The invention described herein can consist of any of various materials of construction, such as, but not limited to plastic, wood, metal, or other and will be referred to as the grip step. This is a shortened name for simplicity sake but it is the same invention described under the title Board Control Grip Step for Snowboards. The grip step can be attached to the board in one of two ways. The first is that the grip step can be screwed directly onto the board either underneath the existing binding or elsewhere. The second way is that the grip step can be part of the binding itself.

The grip step has a platform (5) for the purpose of placing the foot. The platform (5) can have a rough surface so as to maintain contact between the rider's foot and the grip step. The platform (5), also known as the step, could be angled, curved, or flat. The platform (5) is connected by cross-bars (1) to the base (4) that contacts the snowboard (11). The cross-bars (1) act as levers in a fulcrum (6) and lever (1) system to convert a downward force applied to one edge of the step (5) to a lifting force on the opposite edge of the snowboard (11).

The method for constructing the grip step can involve the manufacture of individual parts that when assembled form the whole. These parts can include, but are not limited to, the base (4) that is cut from a sheet of material or is molded into a certain shape or size. Cross-bars (1) that are made to direct the downward force of the foot into a useful direction for steering. The cross-bars (1) can also be cut from a sheet of material or molded into a certain size and shape. The last major constituent of the apparatus is the actual step (5) that can also be cut from a material sheet or molded in a certain shape or size. These three main constituents make up the body of the invention with supplement devices such as springs, hinges (8), pins, screws, and other hardware completing the invention. These can be made as they are currently mass produced and no special construction is required for them.

The utilization of the grip step is the key to this invention. The unique construction and placement of this invention on the snowboard (11) allows steering and control of the snowboard (11) when one foot is unbound superior to that of any device currently available. The common device that is employed to place an unbound foot on a snowboard (11) consists of a pad that is attached to the snowboard (11) to aid the unbound foot in not slipping from the board but offers little to no leverage to control or steer the snowboard (11). The diverted direction of the downward force exerted in the grip step by the rider's unbound foot provides a means for steering by manipulating the edges of the snowboard (11), through a lever (1) and fulcrum (6) system, much like what is done when the foot is bound. Also, the downward force of the rider's unbound foot, when contacted with the gripped surface of the step (5) and the counterforce supplied by a spring or elasticity of the material itself helps to maintain contact between the unbound foot of the rider and the grip step and, ultimately, the snowboard. The grip step's main function is to offer the ability to steer the snowboard (11) using one unbound foot. This action is almost always certainly desired when riding a ski lift or when not moving fast enough to maintain balance with two feet bound to the board.

The best way that the grip step can provide steering of the snowboard (11) by the unbound foot is by diverting forces exerted by the unbound foot's heal or toe pressure forces much as is done when the foot is bound, however, instead of lifting the foot and leaning as is possible when the foot is bound, the grip step uses a fulcrum (6) and lever (1) apparatus to divert the force in the proper direction. For example, by exerting pressure on the toe of the step, for instance, pressure is transferred through the cross-bar levers (1) that connect to the heel part of the base plate and apply a lifting force on the heel part of the base plate (4), and hence, to the heel edge of the snowboard (11). A fulcrum (6) in the form of a raised section of the base (4) could contact the cross-bar (1) acting as the lever (1) and picking up the heel edge of the snowboard (11) so, just as when the foot is bound, toe pressure would allow one to apply pressure to the toe edge of the snowboard (11) and lift the heel edge of the snowboard (11). Heel pressure would allow one to apply pressure to the heel edge of the snowboard (11) and lift the toe edge of the snowboard (11). This enables steering to the right and left.

The invention claimed is:

1. A device for controlling the steering of a snowboard with the user's foot, comprising a grip step mounted on the snowboard (11), said snowboard having at least one binding (10), and wherein the grip step comprises a lever (1) and fulcrum (6) system to counteract a downward force on one longitudinal edge of the snowboard and divert the downward force through the lever and fulcrum system to lift an opposite longitudinal edge of the snowboard; wherein the grip step includes a platform (5) for the user's foot; wherein the platform is connected by the lever and fulcrum system to a base (4); wherein the base lies on the upper surface of the snowboard; wherein the base is hingedly attached to a plate, and wherein said plate mounts underneath the binding.

2. A device such as described in claim 1, wherein the grip step is made part of the binding (10) itself.

3. A device such as described in claim 1, wherein the grip step is not made part of the binding.

4. A device such as described in claim 3, wherein the grip step is mounted underneath the binding (10).

5. A device such as described in claim 1, wherein the lever and fulcrum system comprises cross-bars (1).

6. A device such as described in claim 1, wherein the platform (5) is flat, curved or angled.

7. A method for controlling the steering of a snowboard with the user's foot using a device according to claim 1.

* * * * *